United States Patent [19]

Pittman et al.

[11] Patent Number: 4,580,383

[45] Date of Patent: Apr. 8, 1986

[54] BUILDING PANEL

[75] Inventors: Raymond H. Pittman, Batavia; William J. Schultz, St. Charles, both of Ill.

[73] Assignee: Masonite Corporation, Chicago, Ill.

[21] Appl. No.: 629,903

[22] Filed: Jul. 11, 1984

[51] Int. Cl.[4] ..... E04D 1/00

[52] U.S. Cl. ..... 52/520; 52/524; 52/546

[58] Field of Search ..... 52/520, 518, 519, 524, 52/546, 535, 539, 537

[56] References Cited

U.S. PATENT DOCUMENTS

| | | | |
|---|---|---|---|
| Re. 24,246 | 12/1956 | Fink et al. | 108/8 |
| 373,373 | 11/1887 | Montross . | |
| 2,126,676 | 8/1938 | Thomas | 52/520 |
| 2,264,546 | 12/1941 | Ochs | 20/5 |
| 3,333,384 | 8/1967 | Brady | 52/557 |
| 3,417,531 | 12/1968 | Jones | 52/520 |
| 3,485,004 | 12/1969 | Mattes | 52/520 |
| 3,626,439 | 12/1971 | Kneisel | 52/533 |
| 3,643,394 | 2/1972 | Johnson | 52/309 |
| 3,702,031 | 3/1973 | Wilson et al. | 52/520 |
| 3,703,795 | 11/1972 | Mattes | 52/52 |
| 3,796,586 | 9/1971 | Hanlon et al. | 117/8 |
| 3,828,510 | 8/1974 | Bettoli | 52/519 X |
| 3,848,383 | 11/1974 | Wilson et al. | 52/533 |
| 3,848,384 | 11/1974 | Eaton et al. | 52/420 |
| 3,852,934 | 12/1974 | Kirkhuff | 52/539 |
| 3,868,300 | 2/1975 | Wheeler | 162/124 |
| 3,897,667 | 8/1975 | Turek | 52/546 |
| 3,899,855 | 8/1975 | Gadsby | 52/90 |
| 3,927,501 | 12/1975 | Allen et al. | 52/555 |
| 3,943,677 | 3/1976 | Carothers | 52/309 |
| 4,061,813 | 12/1977 | Geimer et al. | 428/183 |
| 4,065,899 | 1/1978 | Kirkhuff | 52/309.8 |
| 4,102,106 | 7/1978 | Golder et al. | 52/539 X |
| 4,104,841 | 8/1978 | Naz | 52/519 |
| 4,188,762 | 2/1980 | Tellman | 52/541 |
| 4,261,162 | 4/1981 | Tellman | 52/541 |
| 4,266,382 | 5/1981 | Tellman | 52/316 |
| 4,279,106 | 7/1981 | Gleason et al. | 52/100 |
| 4,308,702 | 1/1982 | Rajewski | 52/519 |
| 4,366,197 | 12/1982 | Hanlon et al. | 428/43 |

FOREIGN PATENT DOCUMENTS

| | | | |
|---|---|---|---|
| 189198 | 9/1907 | Fed. Rep. of Germany | 52/536 |

*Primary Examiner*—Carl D. Friedman
*Assistant Examiner*—Creighton Smith
*Attorney, Agent, or Firm*—Mason, Kolehmainen, Rathburn & Wyss

[57] ABSTRACT

A building panel for exterior and interior wall and roof surfaces comprises an elongated body formed of relatively thin, molded hardboard having upper and lower edges, opposite ends, an outer face adapted for exposure to the weather and a back face generally following the contour thereof. The body includes a lower edge portion extending upwardly and outwardly of the lower edge of the panel and integralling joining an intermediate fascia portion spaced outwardly of the lower edge. An upper edge portion integrally joins an upper edge of the intermediate fascia portion and includes an upwardly and outwardly extending segment adapted to underlie a lower edge portion of a panel(s) laid up in a next higher course. The upper edge portion also includes a second segment extending between the first segment and the upper edge of the panel and this second segment is generally parallel of the intermedate fascia panel portion and is adapted to underlie a portion of an intermediate fascia portion of a panel(s) laid up in a next higher course. The upper edge portion is formed with a plurality of longitudinally spaced apart, fastener receiving depressions extending inwardly of an outer face of the second segment of the upper edge portion. Longitudinally extending slot means are cut through the thin molded hardboard in the depressions between the inner and outer faces for receiving the shank of a nail or other fastener for securing the panels in place.

14 Claims, 3 Drawing Figures

FIG. 1
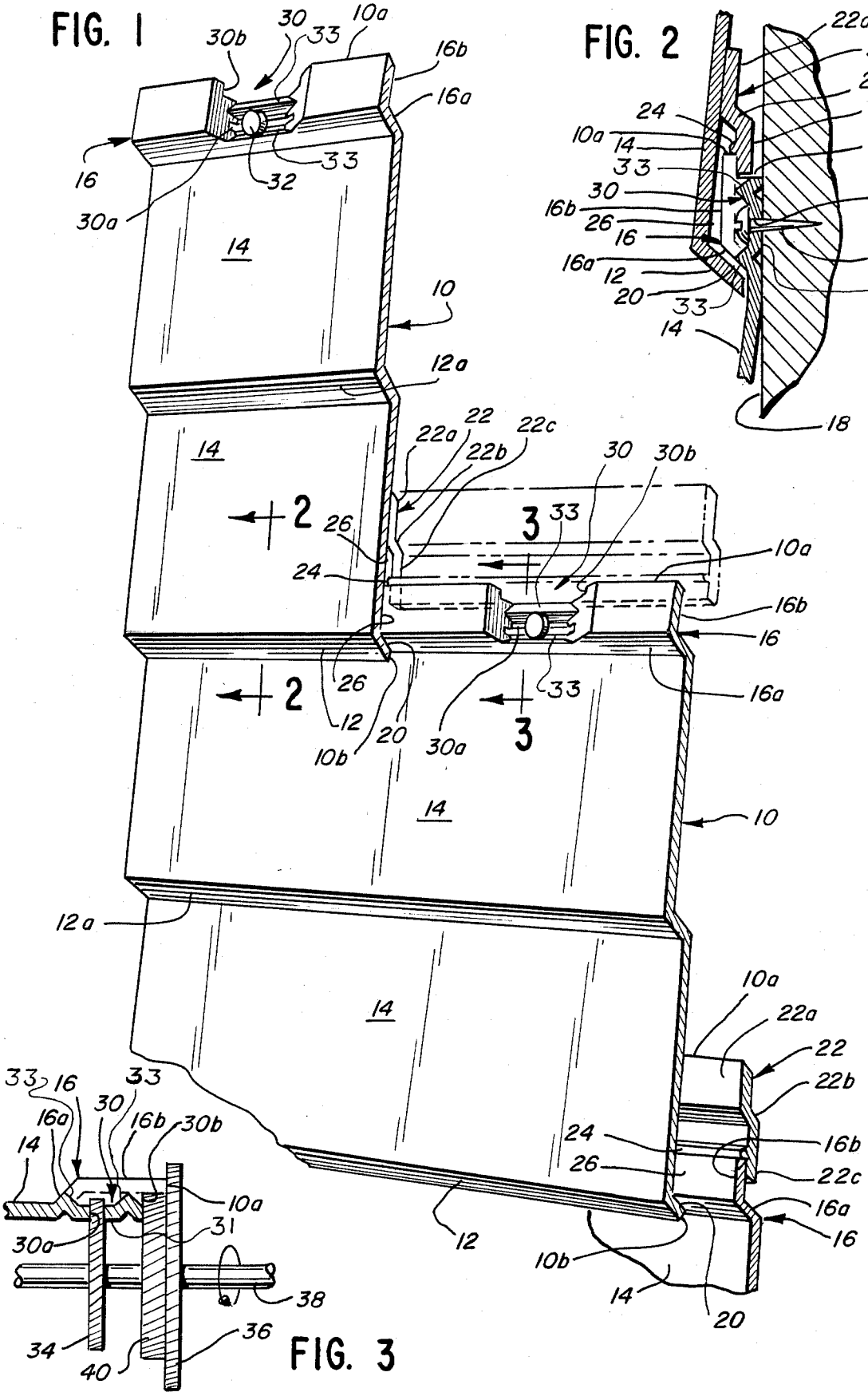
FIG. 3
FIG. 2
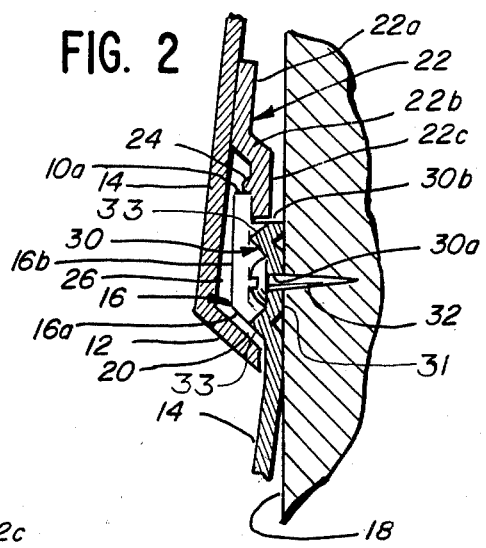

BUILDING PANEL

BACKGROUND OF THE INVENTION

1. Field of the Invention

The present invention relates to a new and improved building panel for exterior and interior wall and roof surfaces of building structures and comprises an elongated body formed of relatively thin wall, molded hardboard material. The elongated panels include intricate, molded profiles which resemble historic lap siding and drop siding products of real wood and are especially designed to be competitive with relatively thick, hardboard panel siding, lap siding, panels, etc. as well as aluminum and vinyl siding materials and conventional wood, asphalt and other siding and roofing material.

2. Description of the Prior Art

In general, hardboard panels, panel siding and lap siding products have been provided with a relatively flat or planar back face and some of these panel products have an outer face or surface adapted for exposure to the weather which is formed in a molding or embossing process or includes grooves formed with cutters or grooving devices so as to resemble a plurality of individual laps or boards formed in a single member.

The following U.S. patents relate generally to roofing and siding panels and products and are listed as follows:

| | | | |
|---|---|---|---|
| Fink et al | RE. 24,246 | Turek | 3,897,667 |
| Montross | 373,373 | Gadsby | 3,899,855 |
| Ochs | 2,264,546 | Carothers | 3,943,677 |
| Brady | 3,333,384 | Allen et al | 4,366,197 |
| Kneisel | 3,326,493 | Eaton | 4,015,392 |
| Johnson | 3,643,394 | Geimer et al | 4,061,813 |
| Mattes | 3,703,795 | Kirkhuff | 4,065,899 |
| Wilson et al | 3,720,031 | Golder et al | 4,102,106 |
| Hanlon et al | 3,796,586 | Tellman | 4,188,762 |
| Wilson et al | 3,848,383 | Tellman | 4,261,152 |
| Eaton et al | 3,848,384 | Tellman | 4,266,382 |
| Kirkhuff | 3,852,934 | Gleason et al | 4,279,106 |
| Wheeler | 3,868,300 | Hanlon et al | 4,366,197 |

OBJECTS OF THE INVENTION

An object of the present invention is to provide a new and improved building panel for exterior and interior wall and roof surface of building structures comprising an elongated body formed of relatively thin-walled, molded hardboard.

More particularly, it is an object of the present invention to provide a building panel of the character described, which panel is molded into intricate profiles or shapes to closely resemble historic profiles of real wood products used in the past for siding and roofing on houses and other building structures.

Yet another object of the present invention is to provide a new and improved building panel of the character described which is especially designed to provide a much greater surface area coverage but with a much lower weight and quantity of material being required.

Still another object of the present invention is to provide and new and improved building panel of the character described which utilizes a new and unique method for providing nail or fastener slots therein adapted to receive nail shanks or other fastener shanks used in securing the panels in place on a wall or roof structure.

Still another object of the present invention is to provide a new and improved building panel of the character described especially adapted to be laid up or applied in overlapping courses and provided with means permitting individual panels to expand and contract without serious disadvantage to the panels such as buckling, cracking splitting or weather leakage.

Yet another object of the present invention is to provide a new and improved building panel of the character described which may be economically produced and which is capable of rapid and easy installation, even by unskilled artisans on a wide variety of building wall and roof structures.

Yet another object of the present invention is to provide a new and improved building panel or lap siding product formed of molded, thin-walled hardboard material which is self-aligning during application and which facilitates the installation thereof by providing elongated fastener receiving slots intermediate the upper and lower edges of the panel.

Yet another object of the present invention is to provide a new and improved building panel of the character described which has greatly improved resistance against wind uplift forces and which provides an excellent weather surface for a building wall or roof structure yet still permitting individual panels to expand and contract in response to the level of moisture contained therein and the temperature change encountered.

BRIEF SUMMARY OF THE PRESENT INVENTION

The foregoing and other objects and advantages are accomplished in an illustrated embodiment of the present invention comprising an elongated building panel formed of relatively thin-walled, molded hardboard material having upper and lower edges, opposite ends, an outer surface molded to resemble historic lap siding or shingle products and adapted for exposure to the weather, and a back face contoured to generally follow the profile in the surface of the outer weather face. The panel includes an elongated body having a lower edge portion extending upwardly and outwardly from a lower edge of the panel and integrally joining an intermediate fascia portion that is spaced outwardly of the lower edge. An upper edge portion integrally joins an upper edge of the intermediate fascia portion and includes an upwardly and outwardly extending first segment which is adapted to underlie a lower edge portion of a panel(s) laid up in a next higher course. The upper edge portion also includes a second segment extending between the first segment and the upper edge of the panel that is generally parallel of the intermediate fascia portion and adapted to underlie a portion of the intermediate fascia of a panel laid up in a next higher course. The upper edge portion has a plurality of longitudinally spaced apart, fastener receiving depressions formed therein in an integral molding process and these depressions extend inwardly from the outer face of the second segment of the upper edge portion. Longitudinally extending slots are cut through the thin-walled, molded hardboard in the area of the depressions between the inner and outer face for receiving fastener shanks used for securing the panels in place on a building wall or roof structure.

BRIEF DESCRIPTION OF THE DRAWING

For a better understanding of the present invention reference should be had to the following detailed description, in which FIG. 1 is a fragmentary elevational perspective view with portions shown in section illustrating building panels in accordance with the present invention laid up in overlapping relation on a building wall structure;

FIG. 2 is a fragmentary cross-sectional view taken substantially along lines 2—2 of FIG. 3 illustrating the interlocking relationship between upper and lower panels laid in overlapping relation; and FIG. 3 is a schematic diagram taken along a section line 3—3 of FIG. 1 illustrating cutting means utilized for providing fastener receiving slots and spaced apart longitudinal intervals along an upper edge portion of the panel.

DESCRIPTION OF A PREFERRED EMBODIMENT

Referring now more particularly to the drawings there is illustrated a new and improved building panel 10 formed of thin-walled, molded hardboard material and especially adapted for both exterior and interior surfaces on walls and roofs of building structures such as single and multifamily dwellings and commercial buildings. The panels 10 are molded to rather intricate profiles and are adapted to replicate and simulate the historical or traditional profiles of panels, lap siding and drop siding made of real wood. The panels are formed of molded hardboard material preferrably in a dry process and have a nominal wall thickness of approximately $\frac{1}{8}''$, which thickness is considerably less than the overall maximum thickness of the panels as a whole. As shown, the panel 10 is designed to replicate beveled lap siding with a double lap profile which simulates a pair of beveled siding planks of real wood. A single lap, triple lap or even a quadruple lap profile may be provided with various lap width dimensions as needed to simulate or replicate traditional siding products.

Along a lower edge portion, each panel is formed with an upwardly and outwardly extending lower butt edge 12 which integrally joins a fascia segment 14 at an obtuse angle as best shown in FIG. 2. The fascia panel 14 may be narrow or relatively wide depending upon the style that is desired and in the embodiment illustrated a pair of fascia portions 14 are provided in a single panel and are separated by an intermediate butt edge 12*a* generally parallel of the lower butt edge 12 situated along the lower panel edge.

Because the molded hardboard material of the panel 10 is relatively thin, large size panels can be utilized and multiple fascia portions may be provided including three, four, five or six fascia portions of 4" width. A panel having six 4" fascia portions is light enough to be easily handled during installation even though the panel is 16 feet in length.

Along an upper edge 10*a* of each panel there is provided an upper edge portion 16 including a first segment 16*a* parallel of the butt edge portions 12 and 12*a* and extending upwardly and outwardly from the adjacent fascia portion 14 at an obtuse angle matching the angle between the intermediate butt edge 12*a* and the lower fascia portion 14. When the panels are laid up in overlapping relation as illustrated in FIGS. 1 and 2, the lower butt edge of a panel or panel(s) in an upper course is adapted to overlie and face the segment 16*a* of the upper edge portion 16 in a lower panel which is in generally parallel relationship as best shown in FIG. 2. When the panels are laid up against the sheathing or other surfaces 18 of a building wall structure as shown in FIG. 2, the lower butt edge 12 is generally parallel and spaced below the first segment 16*a* of the upper edge portion 16 of a next lower panel 12 and this provides a spacing or open area 20 (FIG. 2) to accommodate limited relative movement of the panels which may result from expansion and contraction due to moisture absorption and desorption during prolonged exposure to the weather.

In order to positively interlock a lower edge portion of an upper panel with an upper edge segment 16*b* of a lower panel, each panel is provided with a locking strip 22 preferably formed of molded hardboard material of similar thickness and secured to the back face of the lower fascia portion 14 of the panel by adhesive materials such as glue or mastic. Each locking strip includes an upper segment 22*a* that is firmly secured to the back face of the panel fascia portion and an integral, downwardly and inwardly offset leg 22*b* which integrally joins a lower leg 22*c*. The lower leg is generally parallel and spaced from the back face of the panel fascia portion 14 as best shown in FIG. 2 to provide a space or slot in order to accommodate the upper segment 16*b* of an adjacent lower panel.

In accordance with a feature of the present invention, the lower leg 22*c* of the locking strip 22 is provided with a small rib 24 projecting outwardly toward the back face of the adjacent fascia portion 14 and the rib provides a stop surface for self aligning engagement with the upper edge 10*a* of the next lower adjacent panel as successive panels are laid up in place. The stop or rib 24 on the locking strip is relatively small in transverse cross section and after initial installation of the panel on a building wall or roof structure, if the panels enlarge in size because of heavy absorption of moisture, the rib may be fractured and separated away from the lower segment 22*c* of the locking strip. In the event of such a fracture, the interlocking engagement between the lower segment 22*c* of a locking strip and the upper second segment 16*b* of an engaged lower panel is continuously maintained and the amount of overlap is sufficient between these two elements to permit continuing movement relative to one another without disturbing the interlocking engagement. A space 26 is provided between the back face of the panel fascia portion 14 and the lower segment 22*c* of the strip so that the upper segment 16*b* of an interlocked panel is free to move without binding which might result in buckling if tight restraint was applied.

In accordance with the present invention, the upper edge portion 16 of each panel 10 is formed with a trapezoidal shaped indentation or depression 30 at appropriate intervals along the length thereof. Each indentation 30 is designed to receive a fastener 32 such as a staple or nail (as shown) for securing the upper edge portion of the panel in place against a building wall sheathing or other wall surface 18. The indentations have a base 31 with a back face adapted to bear against a supporting wall structure (FIG. 2) and the outer face of the base includes a pair of spaced apart, parallel, outwardly projecting ribs 33. The ribs 33 are of V-shaped transverse cross-section and the inner, inwardly sloped surfaces thereof serve to guide the head of the nails 32 into place (FIG. 2).

The fastener receiving depressions are generally trapezoidal shaped in longitudinal cross section and are also generally trapezoidal in vertical or transverse cross section as shown in FIG. 2. This shape provides a convenient recess for the head of a fastener and the base of the recess or indentation 30 on the back side of the panels of the panels lies on a plane generally extending through a lower edge 10*b* of the panel on the lower butt edge 12 thereof.

In accordance with an important feature of the present invention, elongated slits 30*a* are cut in the bottom wall of the fastener receiving indentations 30 for accommodating the shanks of the fasteners and these slits are formed by a rotary saw 34 (FIG. 3) which makes a cut parallel to the upper edge 10*a* of the panel, which edge butts against the side of a trimming saw 36 on the saw arbor 38 in parallel spaced relationship to the cutter or saw 34.

The diameter of the saw 34 is less than that of the saw 36 so that the slits 30*a* that are cut in the depressions 30 run completely through the thickness of the hardboard material, yet the saw blade clears the undersurface or backside of the segment 16*b* of the panels except in the areas of the fastener receiving indentations 30 where a slit or cut out 30*a* is to be made. This arrangement permits the slits 30*a* to be cut in a single, longitudinal pass of a panel or blank containing several panels across a supporting table of a saw rather than requring a punch press type operation for sequential punching or drilling in a direction perpendicular to the panel face at spaced apart positions thereon in order to form a row of spaced apart openings for fastener shanks.

A saw 40 slightly larger in diameter than the saw 34 is provided adjacent the edge trimming saw 36 and this saw is designed to cut out slotted segments 30*b* along the upper edge 10*a* of the panel only in the area of the indentations 30. As shown in FIG. 2 the slotted-out segments 30*b* are adapted to receive a lower edge on the lower segment 22*c* of the locking strip 22 on the next adjacent higher panel 10 as the panel is laid up. This arrangement provides for positive interlocking between a locking strip 22 on a higher panel which engages the upper edge portion 16 of a lower panel. It will thus be seen that the nail slots 30*a* for accommodating nails or fastener shanks and the locking strip, slots 30*b* found in each indentation 30 permit a positive interlocking relationship along the upper edge portion 16 of a lower panel and the lower facia portion 14 and locking strip 22 of an adjacent higher panel. The slots 30*a* and 30*b* are formed by longitudinal saw cuts in a single pass of a panel over a table saw and simultaneously, the upper edge 10*a* of the panel is cut and trimmed to size.

Each panel 10 is secured to a building wall or roof surface by a row of spaced apart fasteners or nails 32 applied through the slots 30*a* along an upper edge portion 16 of the panel. The lower portion of each panel is secured to the upper edge portion 16 of a lower panel(s) by means of the interlocking engagements with the joining strip 22. Thus each panel is secured in place along both upper and lower portions. The first or lowest row of panels 10 on a wall or roof are interlocked with a starter strip which is similar in shape and cross section to the portion 16 of the panels and which is nailed in place on the building structure in a fashion similar to the panels themselves.

Although the present invention has been described with reference to an illustrated embodiment thereof, it should be understood that numerous other modifications and embodiments can be made by those skilled in the art that will fall within the spirit and scope of the principles of this invention.

What is claimed as new and desired to be secured by Letters Patent is:

1. A building panel for exterior and interior wall and roof surfaces, comprising:

an elongated body formed of relatively thin, molded hardboard, having upper and lower edges and opposite ends with an outer face adapted for exposure to the weather and a back face opposite thereof;

said body including a lower edge portion extending upwardly and outwardly of a lower edge of said panel and integrally joining an intermediate facia portion spaced outwardly of said lower edge; and an upper edge portion integrally joining an upper edge of said intermediate facia portion and including an upwardly and outwardly extending first segment adapted to underlie a lower edge portion of a panel laid up in a next higher course, said upper edge portion also including a second segment extending between said first segment and said upper edge of said panel generally parallel of said intermediate facia portion and adapted to underlie a portion of an intermediate facia portion of a panel laid up in a next higher course;

said upper edge portion having a plurality of longitudinally spaced apart, fastener receiving depressions formed therein extending inwardly of an outer face of said second segment of said upper edge portion, said depressions having a base spaced below the level of the underside of said second segment in the area spaced outside of said depression; and longitudinally extending slot means cut through said thin molded hardboard in said base of said depressions between said inner and outer face forming slots for receiving fasteners for securing said panel in place.

2. The building panel of claim 1 wherein said depressions are trapezoidal shaped in transverse and longitudinal cross-section.

3. The building panel of claim 1 including a joining strip secured to extend longitudinally of said body along a lower portion on the back face of said intermediate facia portion, said strip having a lower edge portion spaced apart from said facia portion defining a space for receiving said second segment of a next lower panel in interlocking relation therewith.

4. A building panel for exterior and interior wall and roof surfaces, comprising:

an elongated body formed of relatively thin, molded hardboard, having upper and lower edges and opposite ends with an outer face adapted for exposure to the weather and a back face opposite thereof;

said body including a lower edge portion extending upwardly and outwardly of a lower edge of said panel and integrally joining an intermediate facia portion spaced outwardly of said lower edge; and an upper edge portion integrally joining an upper edge of said intermediate facia portion and including an upwardly and outwardly extending first segment adapted to underlie a lower edge portion of a panel laid up in a next higher course, said upper edge portion also including a second segment extending between said first segment and said upper edge of said panel generally parallel of said intermediate facia portion and adapted to underlie a portion of an intermediate facia portion of a panel laid up in a next higher course;

said upper edge portion having a plurality of longitudinally spaced apart, fastener receiving depressions formed therein extending inwardly of an outer face of said second segment of said upper edge portion, said depressions having a base spaced below the level of the underside of said second segment in the area spaced outside of said depression;

longitudinally extending slot means cut through said thin molded hardboard in said base of said depressions between said inner and outer face forming slots for receiving fasteners for securing said panel in place;

a joining strip secured to extend longitudinally of said body along a lower portion on the back face of said intermediate facia portion, said strip having a lower edge portion spaced apart from said facia portion defining a space for receiving said second segment of a next lower panel in interlocking relation therewith; and second longitudinal slot means formed along said upper edge of said panel by a longitudinal cut in said depressions for receiving a lower edge portion of a joining strip on a panel in a next upper course in interlocking relation therewith.

5. The building panel of claim 4 wherein said second slot means comprises a longitudinal cut below the level of said second segment of said upper portion outside of said depressions.

6. The building panel of claim 5 wherein said first mentioned slot means and said second slot means are in spaced apart parallel relation.

7. The building panel of claim 6 wherein said first mentioned slot means and said second slot means are separated by an outwardly projecting rib on the base of said depression.

8. The building panel of claim 7 wherein said first mentioned slot means is separated from said intermediate facia portion by a portion of said first segment of said upper edge portion.

9. A method of making a building panel of thin-walled, molded hardboard material, comprising the step of:

mold forming an elongated panel body having a lower edge portion, an intermediate facia portion and an upper edge portion having a first segment generally parallel of said lower edge portion and a secured segment generally parallel and outwardly of said facia portion;

mold forming a plurality of fastener receiving depressions in said upper edge portions at longitudinally spaced apart intervals having bases below the level of an underside of said second segment outside of said depressions; and cutting longitudinal nail slots in said base of said depressions at a level below said an underside of said second segment outside of said depressions.

10. The method of claim 9 wherein said longitudinal nail slots are cut in a longitudinal pass of said panel reltive to a saw spaced below the level of said underside of said second segment of said upper edge portion outside said depressions.

11. The method of claim 9 including the step of cutting second longitudinal slots along an upper edge of said panel in said depressions at a level below said underside of said second segment of said upper edge portion outside of said depressions.

12. The method of claim 11 wherein said longitudinal nail slots and said second longitudinal slots are parallel and are cut in a single longitudinal pass of said panel relative to saws spaced below the level of said underside of said second segment of said upper edge portion outside of said depressions.

13. The method of c1aim 9 including the step of securing a joining strip on said back face of said intermediate facia portion of said panel adjacent a lower level of said panel to provide an interlocking relation with a second segment of a panel extending into a space between said strip and back face of said intermediate facia portion.

14. The method of claim 13 wherein said second longitudinal slos are positioned to receive a lower edge of said joining strip on a panel placed in interlocking relation in a next higher course.

* * * * *

UNITED STATES PATENT AND TRADEMARK OFFICE

CERTIFICATE OF CORRECTION

PATENT NO. : 4,580,383

DATED : April 8, 1986

INVENTOR(S) : Raymond H. Pittman et al

It is certified that error appears in the above-identified patent and that said Letters Patent are hereby corrected as shown below:

Col. 8, line 8, "secured" should read -- second --;

20, "reltive" should read -- relative --;

42, "slos" should read -- slots --.

Signed and Sealed this

Seventh Day of October, 1986

[SEAL]

*Attest:*

DONALD J. QUIGG

*Attesting Officer*

*Commissioner of Patents and Trademarks*